US010426268B1

(12) United States Patent
Mabon

(10) Patent No.: US 10,426,268 B1
(45) Date of Patent: Oct. 1, 2019

(54) FURNITURE CUSHION

(71) Applicant: L&P Property Management Company, South Gate, CA (US)

(72) Inventor: Lewis A. Mabon, Trinity, NC (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 15/961,942

(22) Filed: Apr. 25, 2018

(51) Int. Cl.
*A47C 7/34* (2006.01)
*A47C 7/18* (2006.01)

(52) U.S. Cl.
CPC . *A47C 7/34* (2013.01); *A47C 7/18* (2013.01)

(58) Field of Classification Search
CPC .. A47C 7/34; A47C 7/347; A47C 7/18; A47C 7/185; A47C 7/20
See application file for complete search history.

(56) References Cited

U.S. PATENT DOCUMENTS 371,448 A * 10/1887 Hale ..... A47C 27/05 267/94
3,765,038 A * 10/1973 Curtis ..... A47C 7/24 297/452.51
4,429,427 A * 2/1984 Sklar ..... A47C 27/20 5/654.1
5,924,682 A * 7/1999 Bullard ..... F16F 1/08 267/103
6,056,278 A * 5/2000 Bullard ..... A47C 7/24 267/91
8,671,483 B2 * 3/2014 Bullard ..... A47C 27/066 5/654.1
9,414,682 B1 * 8/2016 Mezzera ..... A47C 7/34

* cited by examiner

*Primary Examiner* — Philip F Gabler
(74) *Attorney, Agent, or Firm* — Wood, Herron & Evans, LLP

(57) ABSTRACT

A furniture cushion comprises a matrix of pocketed springs, each spring of which is contained within a pocket of fabric. Foam at least partially surrounds the matrix and is secured to a cushion frame. The foam is bowed upwardly over the matrix of pocketed springs to create a crown. A webbing sheet underneath an opening in the cushion frame creates a cavity inside which the matrix of pocketed springs resides. The flexibility of the webbing sheet and crown of the foam create an active suspension system which provides support and comfort.

20 Claims, 3 Drawing Sheets

FURNITURE CUSHION

FIELD OF THE INVENTION

This invention relates generally to furniture cushions and, more particularly, to furniture cushions including foam.

BACKGROUND OF THE INVENTION

Typically, slip seat cushions in the furniture industry are made of a piece of foam secured on top of a wood board and polyester material on the foam all surrounded by a cover. Slip seat cushions are typically secured with screws to a furniture piece such as a chair for easy removal.

To obtain a desired crown or bowed portion in the cushion, additional foam has been added to the center of the cushion. One disadvantage of using such additional foam is that foam is relatively expensive; foam cost has been rising significantly faster in recent history than most other types of raw materials. The cost of foam is more volatile in general than other types of cushion components. Foam scrap from the fabricating process is not fully recyclable—it can only be shredded for use in low-value products or for making re-bonded foam. Foam loses a significant portion of its support very early in its life cycle, so a foam core cushion will lose support characteristics quickly during its life cycle, and will continue to lose support over the entire life cycle, leading to decreased consumer satisfaction and increased consumer returns. Foam has significantly less push back when a load is removed, compared to the resistance of the foam when the load is applied—this is felt by the occupant as less push from a cushion when getting up from the seated position. Foam is difficult to manufacture with consistency, and any given lot of foam will vary in its density and firmness. Foam is the most flammable of the cushion component choices. Smoldering foam creates toxic and explosive gases. Burning foam creates toxic gases. Foam cannot be manufactured with any post-consumer recycled content. Used foam is not practical to recycle.

A pocketed coil spring assembly such as used in a mattress retains most of its support characteristics throughout its life cycle, so a cushion made with pocketed coils will retain more of its original support throughout its useful life. A pocketed spring assembly is more resilient than foam, pushing back with essentially the same force when a load is removed, as it resists the load when it is applied. Pocketed coils are more consistent in firmness than foam, so any cushion made with pocketed coil springs will typically be more consistent than a foam cushion.

It is therefore an objective of this invention to reduce the amount of polyurethane foam incorporated into an upholstered furniture cushion.

Another objective of this invention is been to provide a furniture cushion that incorporates a pocketed spring assembly into a cavity of a slip seat board.

Another objective of this invention is been to provide a furniture cushion that has a crowned center portion created by a pocketed spring assembly.

SUMMARY OF THE INVENTION

Accordingly, in one aspect, the invention is a furniture cushion comprising a cushion frame having a central opening and a webbing sheet secured to a bottom surface of the cushion frame to define a cavity inside the opening of the cushion frame. A matrix of pocketed springs is at least partially inside the cavity is supported by the webbing sheet inside the central opening of the cushion frame. The matrix of pocketed springs extends above the cushion frame to provide a bump over which foam extends. The foam overlays the matrix of pocketed springs and is secured to a top surface of the cushion frame. A cover is secured to the cushion frame and surrounds the foam, matrix of pocketed springs and cushion frame. The springs may be formed to be taller than the pockets, whereby the springs are pre-loaded in the pockets.

In another aspect, the invention is a cushion for piece of furniture comprising a generally rectangular cushion frame having a generally rectangular central opening and a webbing sheet secured to a bottom surface of the cushion frame to define a cavity inside the generally rectangular opening of the cushion frame. A matrix of pocketed springs supported by the webbing sheet is at least partially inside the cavity. The matrix of pocketed springs extends above the cushion frame to provide a bump over which foam extends. A bowed piece of foam overlays the matrix of pocketed springs and iss secured to a top surface of the cushion frame. A cover is secured to the cushion frame and covers the foam, matrix of pocketed springs and part of the cushion frame. The springs may be formed to be taller than the pockets, whereby the springs are pre-loaded in the pockets.

The foam can be polyurethane foam. The density of the polyurethane foam can range from about 1.5 pounds per cubic foot to about 3.0 pounds per cubic foot. The springs can be formed to be taller than the pockets, whereby the springs are pre-loaded in the pockets.

In yet another aspect, a method of making a furniture cushion is provided. The method comprises providing a generally rectangular cushion frame having a generally rectangular opening. The next step comprises securing a webbing sheet to a bottom surface of the cushion frame to create a cavity inside the generally rectangular opening of the cushion frame. A matrix of pocketed springs is inserted into the cavity such that the matrix of pocketed springs is supported by the webbing sheet. The height of the matrix of pocketed springs is greater than the height of the cushion frame so a bump is created in the center of the cushion by the matrix of pocketed springs. The next step comprises wrapping a piece of foam around the matrix of pocketed springs and securing the piece of foam to the cushion frame. The center of the foam piece is pushed upwardly, resulting a crown desired in furniture cushions. The last step comprises placing a cover around the piece of foam and securing the cover to the cushion frame. Typically, the cover is stapled to the cushion frame, but may be secured in any known manner.

One advantage of the present invention is that the amount of polyurethane foam is reduced compared to prior art furniture cushions.

Yet another advantage of the present invention is that the matrix of pocketed springs resting on a webbing sheet provides superior comfort to a user.

These and other objectives and advantages of the present invention will become more readily apparent during the following Description of the Drawings herein.

DETAILED DESCRIPTION OF THE DRAWINGS

Figure 1:
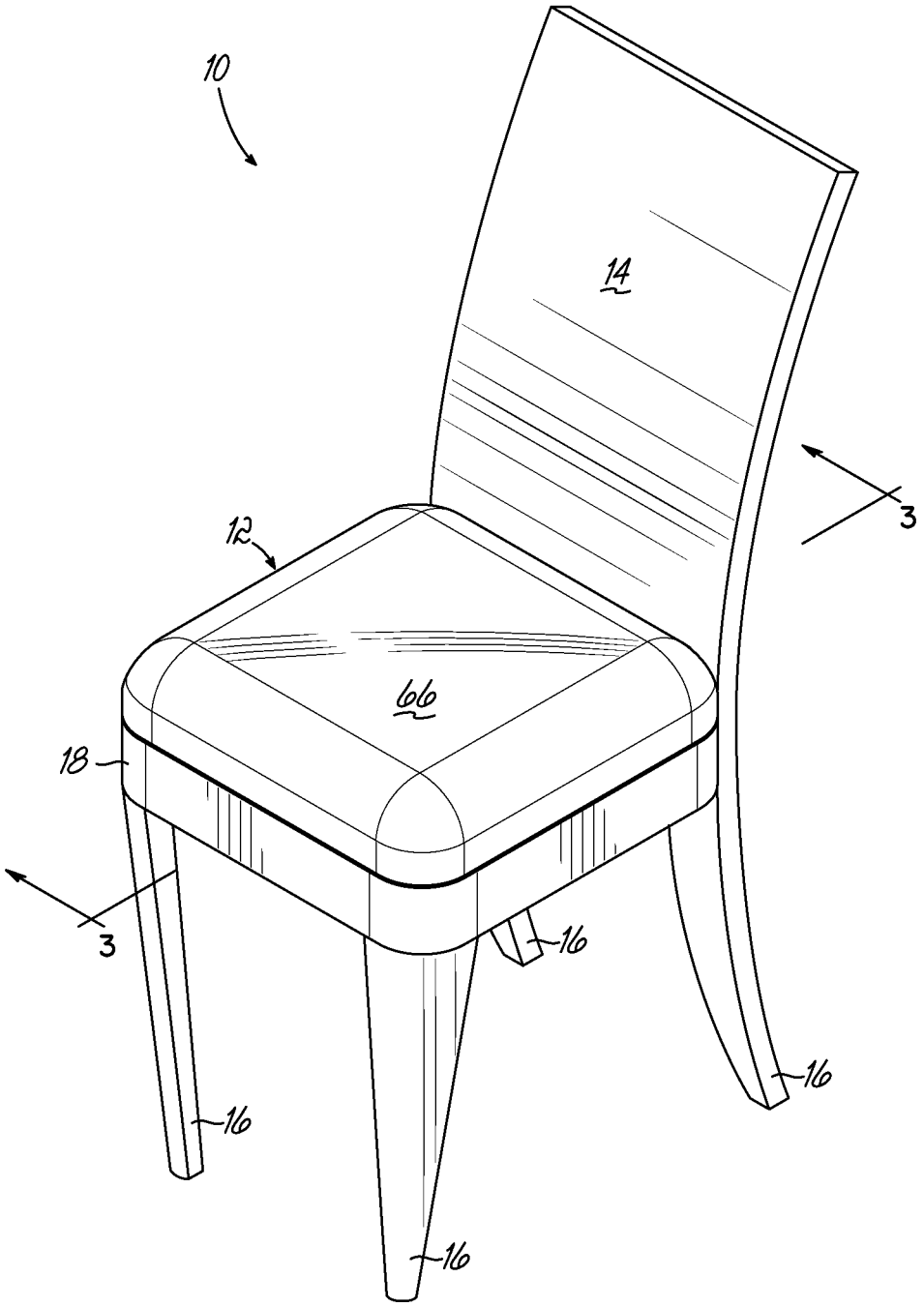
FIG. 1 is a perspective view of a furniture piece equipped with the cushion of the present invention.

Referring to the drawings, a furniture piece 10 in the form of a chair includes a cushion 12, according to the present invention. Although the cushion 12 is illustrated being used as part of a chair, the cushion 12 may be used in any known furniture piece and is not intended to be limited by the drawings. Similarly, the size of the cushion 12 is not intended to be limited by the drawings.

Figure 2:
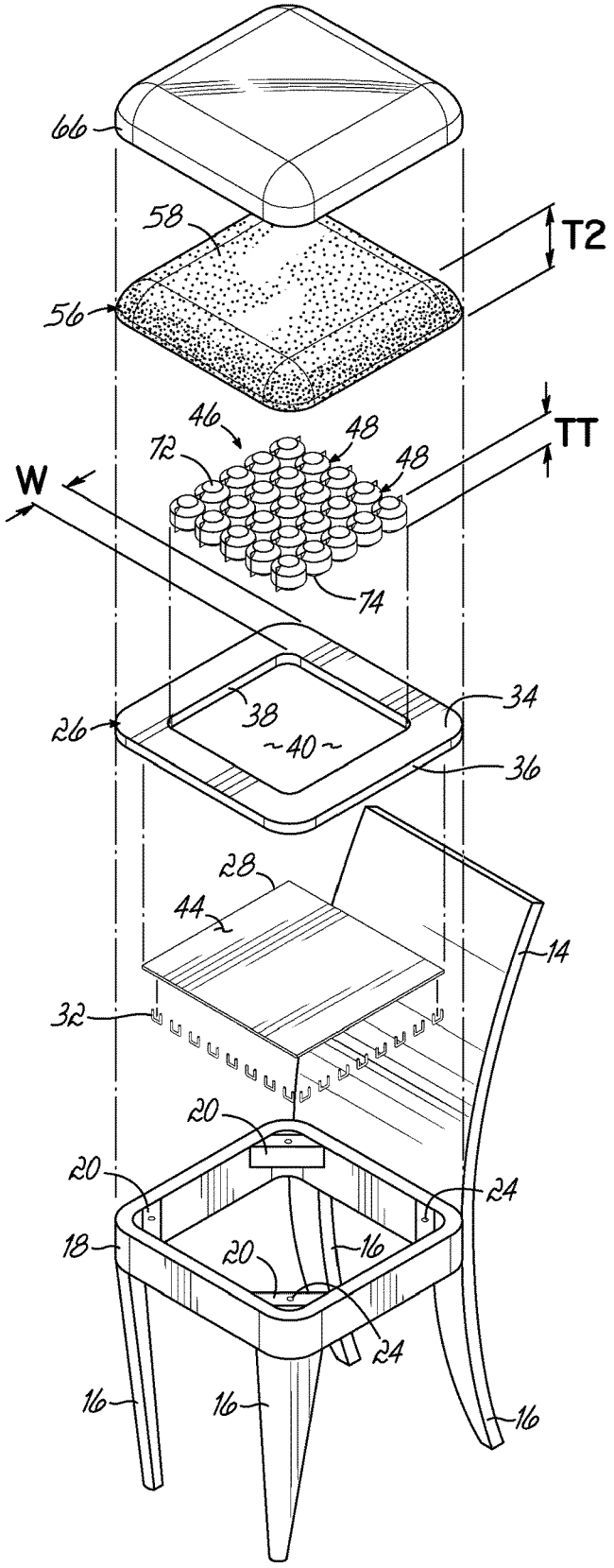
FIG. 2 is a partially disassembled perspective view of the furniture piece of FIG. 1.
Figure 3:
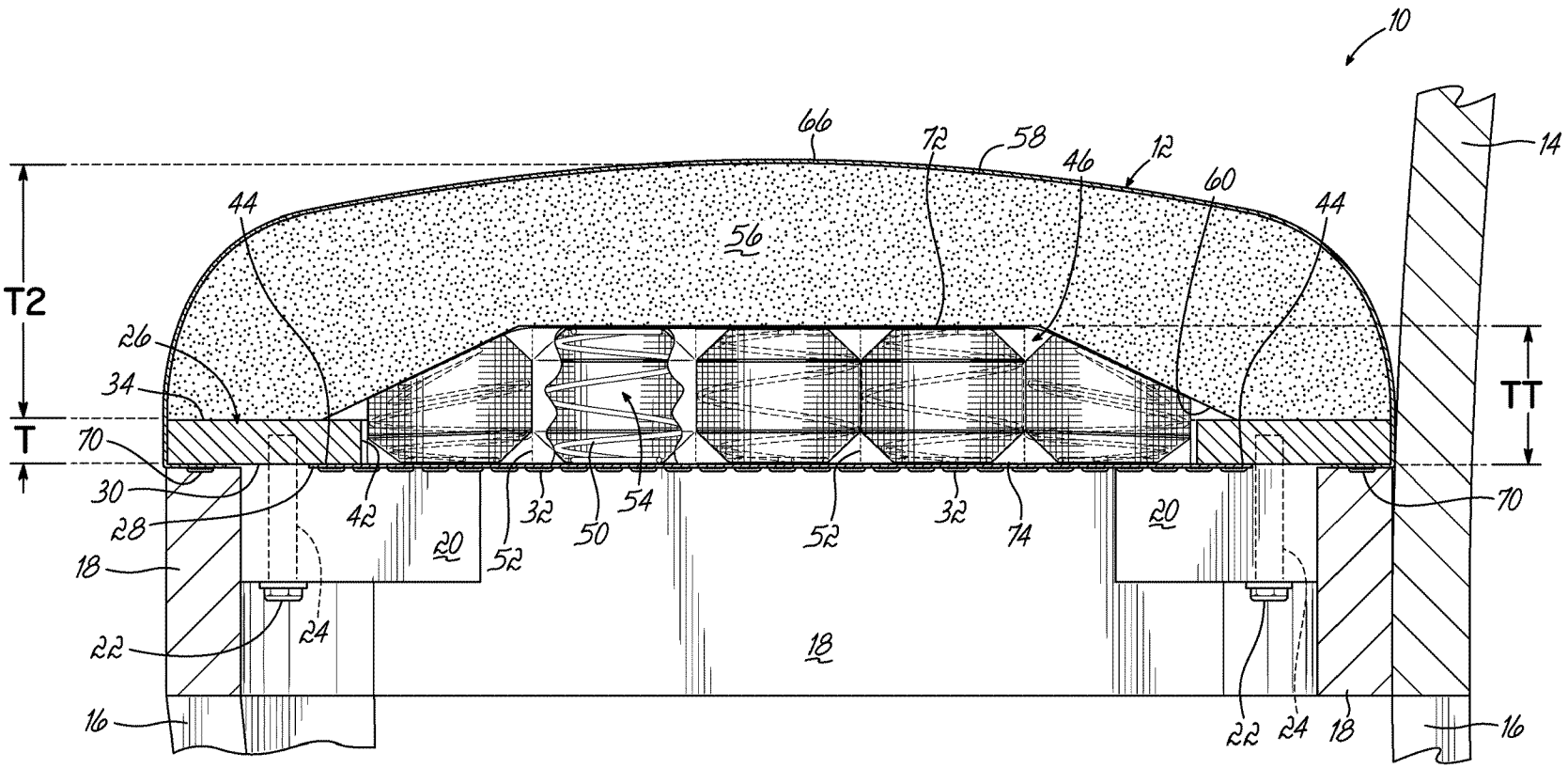
FIG. 3 is a cross-sectional view taken along line 3-3 of FIG. 1.

As best illustrated in FIG. 2, the chair 10 has a back 14, four legs 16, a rectangular seat frame 18 and four corner brackets 20 inside the rectangular seat frame 18 and secured thereto. Although the seat frame 18 is illustrated being rectangular it may be other shapes such as tapered, for example. As shown in FIG. 3, the cushion 12 is secured to the four corner brackets 20 with fasteners 22 (only two fasteners 22 being shown in FIG. 3). Each fastener 22 extends through an opening 24 in one of the corner brackets 20 and into a cushion frame 26 of the cushion 12 as described below.

The cushion 12 includes a webbing sheet 28 secured to a bottom surface 30 of the cushion frame 26 with staples 32. As best shown in FIG. 2, the cushion frame 26 has a top surface 34, an outer surface 36 and an inner surface 38. The inner surface 38 of the cushion frame 26 defines a generally rectangular shaped central opening 40 in the cushion frame 26. As best shown in FIG. 3, the linear distance between the top and bottom surfaces 34, 30, respectively, defines the thickness "T" of the cushion frame 26. In one embodiment, the thickness "T" of the cushion frame 26 is ⅝ inches. However, the thickness "T" of the cushion frame 26 may be any desired length less than the height of the matrix 46 of pocketed springs. The linear distance between the inner and outer surfaces 38, 36, respectively, defines the width "W" of the cushion frame 26. A cavity 42 is defined by an upper surface 44 of the webbing sheet 28 and the central opening 40 in the cushion frame 26.

The cushion frame 26 is preferably made of a material containing wood, such as chipboard. However, the cushion frame 26 may be made of any desired material.

The cushion 12 further comprises a matrix 46 of pocketed springs supported by the webbing sheet 28 inside the cavity 42. The matrix 46 of pocketed springs has an upper surface 72 and a lower surface 74. The lower surface 74 of the matrix 46 of pocketed springs contacts the upper surface 44 of the webbing sheet 28. However, one of more cushioning layers may be inserted therebetween.

The linear distance between the upper and lower surfaces 72, 74, respectively, of the matrix 46 of pocketed springs defines the thickness "TT" of the matrix 46 of pocketed springs. In one embodiment, the thickness "TT" of the matrix 46 of pocketed springs is 1.5 inches. However, the thickness "TT" of the matrix 46 of pocketed springs may be any desired distance greater than the height "T" of the cushion frame 26.

The matrix 46 of pocketed springs comprises multiple continuous strings 48 of pocketed springs cut to a specified length and then secured to other strings 48 by side gluing or the like. Each string 48 comprises a piece of fabric wrapped around a plurality of coil springs 50 and secured to itself with one longitudinal seam (not shown), usually a side seam, and multiple separating seams 52 separating individual coil springs 50 in pockets 54 of fabric. One preferred shape of pocketed coil spring 50 is barrel-shaped as shown. However, the pocketed coil springs 50 may be any known shapes such as cylindrical or hour-glass shaped. The coil spring 50 is formed to be taller than the pocket 54 that contains it, creating a condition wherein the coil spring 50 is pre-loaded in the pocket 54. The comfort of the cushion 12 can be controlled by the gauge, diameter, and number of convolutions of the wire in the coil springs 50. The final dimensions of the cushions can be controlled by the height and diameter of the pocketed coil springs, and the number of coil springs per row and number of rows of coil springs per matrix.

The cushion 12 further comprises a foam piece 56 having an upper surface 58 and a lower surface 60. As shown in FIG. 3, upon assembly, the lower surface 60 of the foam piece 56 contacts the upper surface 72 of the matrix 46 of pocketed springs, the upper surface 58 of the foam piece 56 is bowed upwardly and the bottom surface 60 of the piece of foam is secured to the top surface 34 of the cushion frame 26. The foam piece 56 may be made of polyurethane foam or any other known foam material. The foam piece 56 may generally flat before being wrapped around the matrix 46 of pocketed coil springs 50 and secured around its perimeter to the top surface 34 of the cushion frame 26. After being secured in the place, the foam piece 56 has an upward bow or crown desirable in the furniture industry. In one embodiment, the thickness "T2" of the foam piece 56 is 2.0 inches. However, the thickness "T2" of the foam piece 56 may be any desired distance, preferably between 1.5 and 3 inches.

Finally, the cushion 12 comprises an upholstery cover 66 placed around the upper surface 58 of the foam piece 56 and a portion of the cushion frame 26. The upholstery cover 66 is typically stapled with staples 70 to the bottom surface 30 of the cushion frame 26. However, the upholstery cover 66 may be glued or secured in any known manner to the bottom surface 30 of the cushion frame 26.

The invention described herein has advantages over known cushions. The cost of coil spring components are rising less quickly than foam, and tend to be more resilient over time. The present invention reduces the amount of foam used to make the cushion.

The advantages of furniture cushion are similar to those of a traditional furniture cushion, but are maximized due to the presence of the matrix of pocketed springs. A pocketed coil spring unit retains most of its support characteristics throughout its life cycle, so a cushion made with pocketed coils will retain more of its original support throughout use. A pocketed coil spring interior is more resilient than foam interior, pushing back with essentially the same force when a load is removed, as it resists the load when it is added. Coils are typically much more consistent in firmness than foam, so any cushion made with coil content will typically be more consistent than a foam cushion.

The embodiments shown and described are merely for illustrative purposes only. The drawings and the description are not intended to limit in any way the scope of the claims. Those skilled in the art will appreciate various changes, modifications, and other embodiments. All such changes, modifications and embodiments are deemed to be embraced by the claims. Accordingly, the scope of the right to exclude shall be limited only by the following claims and their equivalents.

What is claimed is:

1. A furniture cushion comprising:

a cushion frame having a central opening;

a webbing sheet secured to a bottom surface of the cushion frame to define a cavity inside the opening of the cushion frame;

a matrix of pocketed springs supported by the webbing sheet inside the central opening of the cushion frame, the matrix of pocketed springs comprising strings of individually pocketed springs, adjacent strings being glued together, the matrix being at least partially in the cavity and extending above the cushion frame to create a crown;

a foam piece overlaying the matrix of pocketed springs and having an upper surface and a lower surface, the lower surface of the foam piece being secured directly to a top surface of the cushion frame and the upper surface of the foam piece being bowed upwardly;

a cover secured to the bottom surface of the cushion frame and extending over the foam piece.

2. The cushion of claim 1 wherein the cushion frame is made at least partially of wood.

3. The cushion of claim 1 wherein the matrix of pocketed springs extends from side to side and front to back of the opening of the cushion frame inside the cavity.

4. The cushion of claim 1 wherein said springs are coil springs.

5. The cushion of claim 1 wherein said foam surrounds four sides of said matrix of pocketed springs.

6. The cushion of claim 1 wherein the webbing sheet is stapled to the lower surface of the cushion frame.

7. The cushion of claim 1 wherein said springs are made of 15 gauge wire.

8. The cushion of claim 1 wherein the matrix of pocketed springs is generally square.

9. A furniture cushion comprising:

a generally rectangular cushion frame having a generally rectangular opening;

a webbing sheet secured to a bottom surface of the cushion frame to define a cavity inside the opening of the cushion frame;

a matrix of pocketed springs partially in the cavity and supported on the webbing sheet, each pocketed spring being contained within a pocket of fabric, the matrix extending above the cushion frame to create a crown, the matrix of pocketed springs extending from side to side and front to back of the opening of the cushion frame inside the cavity;

a bowed piece of foam overlaying the matrix of pocketed springs, the bowed piece of foam having a lower surface secured to a top surface of the cushion frame and contacting the matrix of pocketed springs; and a cover secured to the bottom surface of the cushion frame and extending over the upper surface of the foam piece.

10. The cushion of claim 9 wherein the cushion frame is made of wood.

11. The cushion of claim 9 wherein the bowed piece of foam is made of polyurethane foam.

12. The cushion of claim 9 wherein said springs are formed to be taller than said pockets, whereby said springs are pre-loaded in said pockets.

13. The cushion of claim 9 wherein the springs are barrel-shaped coil springs.

14. The cushion of claim 9 wherein the webbing sheet is stapled to the lower surface of the cushion frame.

15. The cushion of claim 9 wherein the piece of foam is glued to the top surface of the cushion frame.

16. A method of making a furniture cushion, the method comprising:

providing a generally rectangular cushion frame having a generally rectangular opening;

securing a webbing sheet to a bottom surface of the cushion frame such that the webbing sheet is planar to define a cavity inside the generally rectangular opening of the cushion frame;

inserting a matrix of pocketed springs having a uniform thickness in the cavity such that the matrix extends above the cushion frame;

wrapping a piece of foam around the matrix of pocketed springs and securing the piece of foam directly to a top surface of the cushion frame; and placing a cover around an outer surface of the piece of foam and securing the cover to the cushion frame.

17. The method of claim 16 wherein the piece of foam is glued to the top surface of the cushion frame.

18. The method of claim 16 wherein the cover is secured to a lower surface of the cushion frame.

19. The method of claim 16 wherein the matrix of pocketed springs creates a bow in the piece of foam.

20. The method of claim 16 wherein the webbing sheet is stapled to the bottom surface of the cushion frame.

* * * * *